US010954464B2

(12) United States Patent
Sakamoto et al.

(10) Patent No.: US 10,954,464 B2
(45) Date of Patent: Mar. 23, 2021

(54) LUBRICATING OIL COMPOSITION

(71) Applicant: Cosmo Oil Lubricants Co., Ltd., Tokyo (JP)

(72) Inventors: Koichi Sakamoto, Tokyo (JP); Atsushi Akamatsu, Saitama (JP); Naoki Asami, Saitama (JP)

(73) Assignee: Cosmo Oil Lubricants Co., Ltd., Tokyo (JP)

( * ) Notice: Subject to any disclaimer, the term of this patent is extended or adjusted under 35 U.S.C. 154(b) by 0 days.

(21) Appl. No.: 16/767,787

(22) PCT Filed: Nov. 30, 2017

(86) PCT No.: PCT/JP2017/043201
§ 371 (c)(1),
(2) Date: May 28, 2020

(87) PCT Pub. No.: WO2019/106817
PCT Pub. Date: Jun. 6, 2019

(65) Prior Publication Data

US 2020/0362262 A1 Nov. 19, 2020

(51) Int. Cl.
*C10M 137/10* (2006.01)
*C10M 169/04* (2006.01)
*C10N 30/00* (2006.01)

(52) U.S. Cl.
CPC ..... *C10M 137/10* (2013.01); *C10M 169/04* (2013.01); *C10M 2203/003* (2013.01); *C10M 2223/045* (2013.01); *C10N 2030/42* (2020.05)

(58) Field of Classification Search
CPC ..... C10M 137/10; C10M 169/04; C10M 2203/003; C10M 2223/045; C10N 2030/42
See application file for complete search history.

(56) References Cited

U.S. PATENT DOCUMENTS

2005/0209112 A1* 9/2005 Clason ..... C10M 141/10 508/378
2013/0137616 A1* 5/2013 Boffa ..... C10M 137/10 508/371

FOREIGN PATENT DOCUMENTS

JP H03-20396 A 1/1991
JP 2009-144098 A 7/2009
JP 2010-121063 A 6/2010

* cited by examiner

*Primary Examiner* — Taiwo Oladapo
(74) *Attorney, Agent, or Firm* — Banner & Witcoff, Ltd.

(57) ABSTRACT

A lubricating oil composition including: at least one base oil selected from a mineral oil-based lubricating oil, a synthetic oil-based lubricating oil, or a mixed oil thereof, and zinc dialkyldithiophosphates X consisting of the compounds $Z_1$ to $Z_3$ represented by the formulae (1) to (3) are contained, in which a total content of the zinc dialkyldithiophosphates X is 0.02% by mass or more in terms of phosphorus concentration with respect to the total mass of the oil composition, and the zinc dialkyldithiophosphates X satisfy the formulae (a) to (c). In the formula (1), each of $R^1$ to $R^4$ independently represents a linear or branched primary alkyl group having from 10 to 20 carbon atoms. In the formula (2), each of $R^5$ to $R^8$ independently represents a linear or branched primary alkyl group having from 7 to 9 carbon atoms. In the formula (3), each of $R^9$ to $R^{12}$ independently represents a linear or branched primary or secondary alkyl group having from 3 to 6 carbon atoms. The formula (a) to (c) are shown in the specification.

4 Claims, No Drawings

LUBRICATING OIL COMPOSITION

CROSS-REFERENCE TO RELATED APPLICATIONS

This application is a National Stage Application under 35 U.S.C. 371 of co-pending PCT application number PCT/JP2017/043201 designating the United States and filed Nov. 30, 2017, the disclosure of which is incorporated herein by reference in its entirety.

TECHNICAL FIELD

The present disclosure relates to a lubricating oil composition.

BACKGROUND ART

Examples of agricultural machines include tractors as working machines for ground leveling, rice transplanters as working machines for growth management, and binders and combines as working machines for harvesting, and tractors are most widely used among agricultural machines.

Although tractors are provided with many contact spots of metals of hydraulic pump units, transmission units, power-take-off (PTO) clutch units, differential gear mechanism units, wet brake units, and the like, one kind of lubricating oil for agricultural machines is often used in such contact spots.

Thus, lubricating oils for agricultural machines are demanded to have multiple functions such as friction characteristics, wear resistance, oxidative stability, rust-inhibiting properties, and organic material compatibility.

Agricultural machines often cause incorporation of water into lubricating oils to be observed in the course of use because such machines are sometimes used in the environment in which any contact with water such as rice paddies. Therefore, functions of agricultural machines are demanded to be retained even under the environment in which incorporation of water is made.

In particular, water is easily incorporated into oil tanks in use of agricultural machines in rice paddies or due to washing of machines. In a case in which water is incorporated to thereby cause emulsions to be generated in lubricating oils, filter clogging occurs. Thus, lubricating oils are desired to be excellent in suppression of emulsion generation.

For example, Japanese Patent Application Laid-Open (JP-A) No. 2009-144098 discloses a lubricating oil composition for agricultural machines, in which the oil composition contains a zinc dialkyldithiophosphate having a primary alkyl group ($R^1$, $R^2$, $R^3$, and $R^4$) having 8 or more carbon atoms, represented by the general formula (1), one or more metallic cleansers selected from basic calcium sulfonate or basic calcium phenate, and one or more selected from a succinimide having an polyalkenyl group having an average molecular weight of from 800 to 2600 or a boron derivative thereof, in respective predetermined amounts, and has a kinetic viscosity at 0° C., of 250 $mm^2/s$ or less, as a lubricating oil composition for agricultural machines which is also excellent in demulsification properties.

For example, JP-A No. 2010-121063 discloses a lubricating oil composition for agricultural machines, in which the oil composition contains a lubricating oil base oil, (A) a zinc dialkyldithiophosphate having a secondary alkyl group ($R^1$ to $R^4$) having from 3 to 6 carbon atoms, represented by the general formula (1), in an amount of from 0.1 to 0.4% by mass in terms of amount of zinc with respect to the total amount, (B) one or more selected from a calcium sulfonate having a base number of 150 mg KOH/g or more or a calcium phenate having a base number of 150 mg KOH/g or more, in an amount of from 0.1 to 0.5% by mass in terms of amount of calcium with respect to the total amount, and (C) a calcium sulfonate having a base number of 50 mg KOH/g or less, in an amount of from 0.05 to 0.3% by mass in terms of amount of calcium with respect to the total amount, as a lubricating oil composition for agricultural machines which enables emulsion generation leading to the occurrence of rust and/or poor oil pressure to be suppressed. A lubricating oil composition is disclosed.

For example, JP-A No. H03-20396 discloses a lubricating oil composition containing a reaction product of overbasic sulfonate and ethoxyphosphate, in an amount of from 0.5 to 10 parts by weight with respect to 100 parts by weight of a base oil, as a lubricating oil composition for wet brakes/clutches which does not cause any precipitate due to a reaction with water to be generated.

SUMMARY OF INVENTION

Technical Problem

However, evaluations of suppression of emulsion generation (namely, demulsification properties) in the prior art have been merely evaluations under conditions at around normal temperature. Accordingly, for example, the lubricating oil compositions described in JP-A No. H03-20396, JP-A No. 2009-144098, and JP-A No. 2010-121063 have elicited concerns about emulsion generation and filter clogging, in cases in which such lubricating oil compositions are exposed to a low temperature for a long period of time or are temporarily at a high temperature, after incorporation of water into such compositions. Thus, further improvement of such lubricating oil compositions is demanded.

One embodiment of the disclosure has been made in view of the above and provides a lubricating oil composition that is excellent in suppression of emulsion generation due to change in temperature after incorporation of water and that is excellent in filterability.

Solution to Problem

The inventors have made intensive studies, and as a result, have found that a plurality of zinc dialkyldithiophosphates each having a specified structure are compounded in a specified base oil, at a specified proportion in terms of phosphorus concentration, thereby allowing a lubricating oil composition to be suppressed in emulsion generation therein and to be excellent in filterability, even in the case of exposure of the lubricating oil composition to a low-temperature or high-temperature environment after incorporation of water into the oil composition.

The disclosure encompasses the following aspects.

<1> A lubricating oil composition including at least one base oil selected from a mineral oil-based lubricating oil, a synthetic oil-based lubricating oil, or a mixed oil thereof, and zinc dialkyldithiophosphates X consisting of a compound $Z_1$ represented by the following general formula (1), a compound $Z_2$ represented by the following general formula (2), and a compound $Z_3$ represented by the following general formula (3), wherein:

a total content of the zinc dialkyldithiophosphates X, in terms of phosphorus concentration, is 0.02% by mass or more with respect to a total mass of the oil composition, and the zinc dialkyldithiophosphates X satisfy the following formula (a), formula (b) and formula (c).

(1)

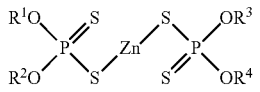

In the general formula (1), each of $R^1$, $R^2$, $R^3$ and $R^4$ independently represents a linear or branched primary alkyl group having from 10 to 20 carbon atoms.

(2)

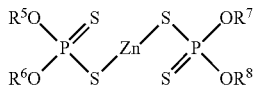

In the general formula (2), each of $R^5$, $R^6$, $R^7$ and $R^8$ independently represents a linear or branched primary alkyl group having from 7 to 9 carbon atoms.

(3)

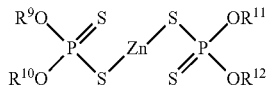

In the general formula (3), each of $R^9$, $R^{10}$, $R^{11}$ and $R^{12}$ independently represents a linear or branched primary or secondary alkyl group having from 3 to 6 carbon atoms.

$0.30 \leq P_1/P \leq 0.50$ formula (a)

$1.00 \leq P_1/P_2 \leq 2.00$ formula (b)

$0.05 \leq P_3/P \leq 0.50$ formula (c)

P in the formula (a) and the formula (c) represents the total content of the zinc dialkyldithiophosphates X in terms of phosphorus concentration with respect to the total mass of the oil composition, $P_1$ in the formula (a) and the formula (b) represents a content of the compound $Z_1$ in terms of phosphorus concentration with respect to the total mass of the oil composition, $P_2$ in the formula (b) represents a content of the compound $Z_2$ in terms of phosphorus concentration with respect to the total mass of the oil composition, and $P_3$ in the formula (c) represents a content of the compound $Z_3$ in terms of phosphorus concentration with respect to the total mass of the oil composition.

<2> The lubricating oil composition according to <1>, wherein each of $R^1$, $R^2$, $R^3$ and $R^4$ in the general formula (1) independently represents a linear primary alkyl group having from 10 to 12 carbon atoms.

<3> The lubricating oil composition according to <1> or <2>, wherein each of $R^9$, $R^{10}$, $R^{11}$ and $R^{12}$ in the general formula (3) independently represents a primary alkyl group having 4 or 5 carbon atoms.

<4> The lubricating oil composition according to any one of <1> to <3>, wherein the lubricating oil composition is an agricultural machinery lubricating oil.

Advantageous Effect of Invention

One embodiment of the disclosure provides a lubricating oil composition that is excellent in suppression of emulsion generation due to change in temperature after incorporation of water and that is excellent in filterability.

DESCRIPTION OF EMBODIMENTS

Hereinafter, embodiments for carrying out the disclosure will be described in detail.

Herein, any numerical range expressed using "to" refers to a range including the numerical values before and after "to" as the upper and lower limit values, respectively. Further, a case in which a unit is stated only for the maximum value in a numerical range expressed using "to" means that the minimum value is also expressed in the same unit.

With respect to numerical ranges stated hierarchically herein, the upper or lower limit value of a certain numerical range of a hierarchical level may be replaced with the upper or lower limit value of a numerical range of another hierarchical level. Further, an upper or lower limit value stated for a certain numerical range in a numerical range stated herein may be replaced with a value set forth in any of the Examples.

Herein, in a case in which plural kinds of substances corresponding to a respective component exist in the composition, the amount of the respective component in the composition means, unless otherwise specified, the total amount of the plural kinds of substances existing in the composition.

Herein, a combination of preferred aspects is a more preferred aspect.

Herein, the "low temperature" means any temperature of 15° C. or less, and, for example, the "under a low temperature environment" means "under any environment at a temperature of 15° C. or less".

Herein, the "high temperature" means any temperature of 50° C. or more, and, for example, the "under a high temperature environment" means "under any environment at a temperature of 50° C. or more".

<<Lubricating Oil Composition>>

The lubricating oil composition of the disclosure contains at least one base oil selected from a mineral oil-based lubricating oil, a synthetic oil-based lubricating oil, or a mixed oil thereof, and zinc dialkyldithiophosphates X consisting of a compound $Z_1$ represented by the following general formula (1), a compound $Z_2$ represented by the following general formula (2), and a compound $Z_3$ represented by the following general formula (3), wherein:

a total content of the zinc dialkyldithiophosphates X, in terms of phosphorus concentration, is 0.02% by mass or more with respect to a total mass of the oil composition, and the zinc dialkyldithiophosphates X satisfy the following formula (a) to formula (c).

The lubricating oil composition of the disclosure contains a specified base oil, and a plurality of zinc dialkyldithiophosphates each having a specified structure at a specified proportion in terms of phosphorus concentration, and thus is excellent in suppression of emulsion generation due to change in temperature after incorporation of water and excellent in filterability. The reason for this, although not clear, is presumed to be as follows. It is noted that the following presumption is not construed to be a limitation of the lubricating oil composition of the disclosure, but rather is described as one example.

Zinc dialkyldithiophosphates differ with respect to characteristics exhibited in a lubricating oil composition depending on differences in the numbers of carbon atoms of alkyl groups and in the structures of the alkyl groups. That is, any zinc dialkyldithiophosphate having an alkyl group in which a carbon atom at the α-position, adjacent to an oxygen atom, is primary carbon and which has a relatively long alkyl chain having, for example, 10 or more carbon atoms tends to be excellent in heat stability and water stability. Any zinc dialkyldithiophosphate having an alkyl group in which a carbon atom at the α-position, adjacent to an oxygen atom, is secondary carbon and which has a relatively short alkyl chain having, for example, 6 or less carbon atoms tends to be excellent in wear preventing properties, antioxidant properties, and suppression of clouding of the lubricating oil composition at a low temperature.

By adjusting any zinc dialkyldithiophosphate having a primary alkyl group and having a number of carbon atoms in the alkyl group in a specified range and any zinc dialkyldithiophosphate having a primary or secondary alkyl group and having a number of carbon atoms in the alkyl group in a specified range so as to be at a specified proportion of the total content of zinc dialkyldithiophosphates in terms of phosphorus concentration and compounding these in a specified base oil, emulsion generation in the lubricating oil composition is suppressed and filterability is excellent, even in a case in which the lubricating oil composition undergoes incorporation of water thereinto and thereafter is exposed to a low-temperature or high-temperature environment.

Hereinafter, each component in the lubricating oil composition of the disclosure will be described in detail.

<Base Oil>

The lubricating oil composition of the disclosure contains at least one base oil selected from a mineral oil-based lubricating oil, a synthetic oil-based lubricating oil, or a mixed oil thereof.

The mineral oil-based lubricating oil is not particularly limited, and any lubricating oil obtained by various production methods may also be used.

Examples of a suitable mineral oil-based lubricating oil include a highly refined paraffin-based mineral oil obtained by subjecting hydrorefined mineral oil, catalyst isomerized oil, or the like to a treatment such as solvent dewaxing or hydrogenation dewaxing.

A base oil for a mineral-based lubricating oil, here used, may be any hydrotreated oil. Examples of the hydrotreated oil include raffinate obtained by solvent refining of a raw material of the base oil with an aromatic extraction solvent such as phenol or furfural, and a hydrotreated oil obtained by hydrotreatment with a hydrotreatment catalyst such as cobalt or molybdenum with silica-alumina as a carrier.

Examples suitably include a mineral oil having a high viscosity index, obtained by a hydrogenolysis process or an isomerization process.

Examples of the synthetic oil-based lubricating oil include a base oil synthesized by a Fischer-Tropsch reaction by use of gas of such as methane as a raw material, a poly-α-olefin oligomer, a polybutene, an alkylbenzene, a polyol ester, a polyglycol ester, polyethylene propylenes, hindered esters, and a dibasic acid ester.

The base oil may further contain a phosphoric ester and a silicone oil as long as the effect of the disclosure is obtained.

The base oil preferably has a kinetic viscosity at 100° C. of from 1.0 $mm^2/s$ to 10.0 $mm^2/s$, more preferably from 2.0 $mm^2/s$ to 8.0 $mm^2/s$, still more preferably from 2.0 $mm^2/s$ to 7.0 $mm^2/s$.

The kinetic viscosity at 100° C. of the base oil can be determined by the same method as in the kinetic viscosity at 100° C. of the lubricating oil composition, as described below.

<Zinc Dialkyldithiophosphate>

The lubricating oil composition of the disclosure contains at least zinc dialkyldithiophosphates X consisting of a compound $Z_1$ represented by the following general formula (1), a compound $Z_2$ represented by the following general formula (2), and a compound $Z_3$ represented by the following general formula (3).

In the lubricating oil composition, a total content of the zinc dialkyldithiophosphates X is 0.02% by mass or more, in terms of phosphorus concentration, with respect to the total mass of the oil composition, and the zinc dialkyldithiophosphates X satisfy formula (a), formula (b), and formula (c), whereby the oil composition is excellent in suppression of emulsion generation due to change in temperature after incorporation of water and excellent in filterability.

The lubricating oil composition of the disclosure contains a compound $Z_1$ represented by the following general formula (1).

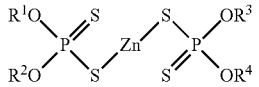

(1)

In the general formula (1), each of $R^1$, $R^2$, $R^3$ and $R^4$ independently represents a linear or branched primary alkyl group having from 10 to 20 carbon atoms.

In a case in which the number of carbon atoms of such each primary alkyl group is 10 to 20, not only emulsion generation in the oil composition tends to be suppressed, but also heat stability is excellent, even in a case in which the oil composition is exposed to a high temperature environment after incorporation of water into the oil composition.

The number of carbon atoms of such each primary alkyl groups represented by each of $R^1$, $R^2$, $R^3$, and $R^4$ is independently preferably from 10 to 16, more preferably from 10 to 14, still more preferably from 10 to 12, particularly preferably 12 from the viewpoint of stability to hydrolysis.

The primary alkyl group represented by each of $R^1$, $R^2$, $R^3$ and $R^4$ preferably has a linear chain from the viewpoint of emulsion generation in incorporation of water.

The "primary alkyl group" herein means that a carbon atom at the α-position, adjacent to an oxygen atom bound to a phosphorus atom in each zinc dialkyldithiophosphate, is primary carbon (namely, —$CH_2$—O—). The "secondary alkyl group" means that a carbon atom at the α-position, adjacent to an oxygen atom bound to a phosphorus atom in each zinc dialkyldithiophosphate, is secondary carbon (namely, >CH—O—).

A content of the compound $Z_1$ is preferably from 0.020% by mass to 0.060% by mass, more preferably from 0.025% by mass to 0.055% by mass, still more preferably from 0.030% by mass to 0.050% by mass, in terms of phosphorus concentration, with respect to the total mass of the oil composition from the viewpoint that stability against water under a high temperature environment and appropriate friction characteristics against a wet friction material are ensured.

The lubricating oil composition of the disclosure contains a compound $Z_2$ represented by the following general formula (2).

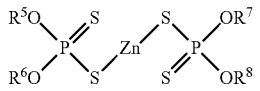

(2)

In the general formula (2), each of $R^5$, $R^6$, $R^7$ and $R^8$ independently represents a linear or branched primary alkyl group having from 7 to 9 carbon atoms.

The primary alkyl group represented by each of $R^5$, $R^6$, $R^7$ and $R^8$ preferably independently represents a linear or branched primary alkyl group having 8 carbon atoms, more preferably a n-octyl group or a 2-ethylhexyl group, still more preferably a 2-ethylhexyl group from the viewpoint that suppression of emulsion generation due to the change in temperature is excellent.

A content of the compound $Z_2$ is preferably from 0.020% by mass to 0.050% by mass, more preferably from 0.025% by mass to 0.045% by mass, in terms of phosphorus concentration, with respect to the total mass of the oil composition from the viewpoint of suppression of emulsion generation due to the change in temperature.

The lubricating oil composition of the disclosure contains a compound $Z_3$ represented by the following general formula (3).

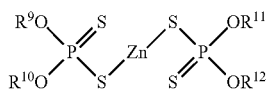

(3)

In the general formula (3), each of $R^9$, $R^{10}$, $R^{11}$ and $R^{12}$ independently represents a linear or branched primary or secondary alkyl group having from 3 to 6 carbon atoms. In a case in which each of $R^9$, $R^{10}$, $R^{11}$ and $R^{12}$ independently represents a primary or secondary alkyl group having 3 to 6 carbon atoms, wear preventing properties tend to be excellent, and suppression of emulsion generation in the oil composition is further excellent in a case in which the oil composition is exposed to an environment at a normal temperature of about 25° C. after incorporation of water into the oil composition.

Each of $R^9$, $R^{10}$, $R^{11}$ and $R^{12}$ more preferably independently represents a primary alkyl group having from 4 to 6 carbon atoms, still more preferably a primary alkyl group having 4 or 5 carbon atoms, from the above viewpoint.

The compound $Z_3$ preferably has at least one preferable alkyl group described above, more preferably 2 or more preferable alkyl groups described above, still more preferably 3 or more preferable alkyl groups described above, particularly preferably 4 or more preferable alkyl groups described above, in the structure. That is, each of $R^9$, $R^{10}$, $R^{11}$ and $R^{12}$ in general formula (3) preferably independently represents a primary alkyl group, in which the number of carbon atoms of such a primary alkyl group is preferably 4 or 5.

A content of the compound $Z_3$ is preferably from 0.003% by mass to 0.040% by mass, more preferably from 0.005% by mass to 0.030% by mass, in terms of phosphorus concentration, with respect to the total mass of the oil composition from the viewpoint that stability against water under a low temperature environment is enhanced.

A total content of the zinc dialkyldithiophosphates X, in terms of phosphorus concentration, is 0.02% by mass or more with respect to a total mass of the oil composition. In a case in which the total content of the zinc dialkyldithiophosphates X is 0.02% by mass or more, not only wear preventing properties and antioxidant properties are sufficiently ensured, but also suppression of emulsion generation is excellent.

The total content of the zinc dialkyldithiophosphates X is preferably 0.04% by mass or more, more preferably 0.05% by mass or more, still more preferably 0.06% by mass or more, particularly preferably 0.07% by mass or more in terms of phosphorus concentration with respect to the total mass of the oil composition from the viewpoint that not only wear preventing properties and antioxidant properties are sufficiently ensured, but also emulsion generation is more suppressed.

The total content of the zinc dialkyldithiophosphates X can be confirmed by, for example, performing an inductively coupled plasma (ICP) emission spectroscopic analysis or the like of the lubricating oil composition.

The content of the zinc dialkyldithiophosphates X, in terms of phosphorus concentration, can be calculated by dividing the content (% by mass) of the zinc dialkyldithiophosphates X, confirmed according to the above-mentioned method, by the atomic weight (=30.97) of phosphorus.

The total content of the zinc dialkyldithiophosphates X is preferably 0.20% by mass or less, more preferably 0.18% by mass or less, still more preferably 0.13% by mass or less, particularly preferably 0.12% by mass or less in terms of phosphorus concentration with respect to the total mass of the oil composition from the viewpoints of heat stability of the lubricating oil composition and friction characteristics of a wet clutch or the like.

The zinc dialkyldithiophosphates X satisfy respective relationships of the following formula (a), formula (b), and formula (c).

In a case in which the zinc dialkyldithiophosphates X satisfy such respective relationships of formula (a), formula (b), and formula (c), suppression of emulsion generation due to change in temperature and filterability are excellent.

$$0.30 \leq P_1/P \leq 0.50 \quad \text{formula (a)}$$

$$1.00 \leq P_1/P_2 \leq 2.00 \quad \text{formula (b)}$$

$$0.05 \leq P_3/P \leq 0.50 \quad \text{formula (c)}$$

P in the formula (a) and formula (c) represents a total content of the zinc dialkyldithiophosphates X in terms of phosphorus concentration with respect to the total mass of the oil composition, $P_1$ in the formula (a) and formula (b) represents a content of the compound $Z_1$ in terms of phosphorus concentration with respect to the total mass of the oil composition, $P_2$ in the formula (b) represents a content of the compound $Z_2$ in terms of phosphorus concentration with respect to the total mass of the oil composition, and $P_3$ in the formula (c) represents a content of the compound $Z_3$ in terms of phosphorus concentration with respect to the total mass of the oil composition.

The ratio ($P_1$/P) of the content ($P_1$) of the compound $Z_1$ in terms of phosphorus concentration with respect to the total mass of the oil composition to the total content (P) of the zinc dialkyldithiophosphates X in terms of phosphorus concentration with respect to the total mass of the oil composition is from 0.30 to 0.50.

In a case in which $P_1$/P is 0.30 or more, hydrolysis stability is relatively excellent. Further, the compound $Z_1$ is moderately contained in the oil composition, whereby suppression of emulsion generation is excellent. In a case in which $P_1$/P is 0.50 or less, the amount of the compound $Z_1$ compounded in the oil composition is not so large and suppression of emulsion generation under a low temperature environment is more excellent.

$P_1/P$ is preferably from 0.35 to 0.50, more preferably from 0.40 to 0.50, still more preferably from 0.44 to 0.50 from the viewpoint of suppression of emulsion generation.

The ratio ($P_1/P_2$) of the content ($P_1$) of the compound $Z_1$ in terms of phosphorus concentration with respect to the total mass of the oil composition to the content ($P_2$) of the compound $Z_2$ in terms of phosphorus concentration with respect to the total mass of the oil composition is from 1.00 to 2.00.

In a case in which $P_1/P_2$ is 1.00 or more, emulsion generation can be suppressed and filter clogging can be suppressed even in a case in which a thermal load is temporarily applied to the oil composition after incorporation of water into the oil composition. In a case in which $P_1/P_2$ is 2.00 or less, emulsion generation in the oil composition can be suppressed even in a case in which the oil composition is exposed to a low temperature environment.

$P_1/P_2$ is preferably from 1.00 to 1.90, more preferably from 1.02 to 1.80, still more preferably from 1.05 to 1.70 from the viewpoint of suppression of filter clogging and emulsion generation.

The ratio ($P_3/P$) of the content ($P_3$) of the compound $Z_3$ in terms of phosphorus concentration with respect to the total mass of the oil composition to the total content (P) of the zinc dialkyldithiophosphates X in terms of phosphorus concentration with respect to the total mass of the oil composition is from 0.05 to 0.50.

In a case in which $P_3/P$ is 0.05 or more, the compound $Z_3$ is moderately contained in the oil composition, whereby emulsion generation can be suppressed.

In a case in which $P_3/P$ is 0.50 or less, the amount of the compound $Z_3$ compounded in the oil composition is not so large and heat stability tends to be excellent.

$P_3/P$ is preferably from 0.05 to 0.40, more preferably from 0.08 to 0.30 from the viewpoints of suppression of emulsion generation and heat stability.

<Other Zinc Dialkyldithiophosphate>

The lubricating oil composition of the disclosure may contain any other zinc dialkyldithiophosphate (hereinafter, also referred to as "such other zinc dialkyldithiophosphate".) than the zinc dialkyldithiophosphates X as long as the effect of the disclosure is obtained.

In a case in which the lubricating oil composition of the disclosure contains such other zinc dialkyldithiophosphate, a content of such other zinc dialkyldithiophosphate is preferably 0.05% by mass or less, more preferably 0.03% by mass or less, still more preferably 0.01% by mass or less in terms of phosphorus concentration with respect to the total mass of the oil composition from the viewpoints of suppression of emulsion generation and friction characteristics of a wet clutch.

(Metallic Cleanser)

The lubricating oil composition of the disclosure may further contain a metallic cleanser. In a case in which the metallic cleanser is contained, friction characteristics of a wet clutch can be ensured.

Examples of the metallic cleanser include alkali earth metal salts such as alkali earth metal sulfonate, alkali earth metal phenate, and alkali earth metal salicylate.

The metallic cleanser which can be here suitably used is alkali earth metal sulfonate from the viewpoint that both suppression of emulsion generation and friction characteristics demanded to be possessed by a wet clutch are satisfied.

The metallic cleanser may be used singly, or in combination of two or more kinds thereof.

The metallic cleanser is preferably an alkali earth metal salt overbased by carbonic acid or boric acid.

The alkali earth metal contained in the metallic cleanser is not particularly limited, and calcium, barium, or the like can be used. In particular, the alkali earth metal is suitably calcium.

The metallic cleanser preferably has a base number of from 150 mg KOH/g to 500 mg KOH/g, more preferably from 200 mg KOH/g to 450 mg KOH/g, still more preferably from 250 mg KOH/g to 450 mg KOH/g, as the base number according to the perchloric acid method of JIS K2501(2003).

The amount of the metallic cleanser compounded is from 0.05% by mass to 0.5% by mass, preferably from 0.15% by mass to 0.45% by mass as the amount of the alkali earth metal based on the total mass of the oil composition.

In a case in which the metallic cleanser is compounded in an amount of the alkali earth metal, of from 0.05% by mass to 0.5% by mass, based on the total mass of the oil composition, favorable friction characteristics are obtained and suppression of emulsion generation is excellent.

(Viscosity Index Improver)

The lubricating oil composition of the disclosure may include a viscosity index improver.

The viscosity index improver is not particularly limited, and examples thereof include known various viscosity index improvers such as a polyalkyl (meth)acrylate, an olefin copolymer, a polyisobutylene, a polyalkylstyrene, a styrene-butadiene hydrogenated copolymer, a styrene-isoprene hydrogenated copolymer, a styrene-maleic anhydride ester copolymer, and those each containing a dispersion group.

In particular, a polyalkyl (meth)acrylate can be suitably used as the viscosity index improver from the viewpoint of favorable viscosity characteristics at a low temperature.

The styrene-butadiene hydrogenated copolymer refers to any copolymer obtained by hydrogenating a styrene-butadiene copolymer to thereby convert the remaining double bond to a saturated bond.

The styrene-isoprene hydrogenated copolymer refers to any copolymer obtained by hydrogenating a styrene-isoprene copolymer to thereby convert the remaining double bond to a saturated bond.

The polyalkyl methacrylate-based viscosity index improver preferably has a weight average molecular weight (Mw) of from 100000 to 600000, more preferably from 100000 to 550000, still more preferably from 100000 to 500000.

In a case in which the weight average molecular weight (Mw) of the polyalkyl methacrylate-based additive is in a range of from 100000 to 600000, low-temperature startability and shear stability tend to be excellent.

The weight average molecular weight (Mw) and the number average molecular weight (Mn) described below mean the weight average molecular weight and the number average molecular weight in terms of polystyrene, respectively, which are each measured with a Shodex GPC-101 apparatus as an apparatus, three columns of Shodex GPC LF-804, and a detector RI (differential refractive index detector), at a temperature of 40° C., a flow rate of a mobile phase of THF (tetrahydrofuran), of 1 mL/min, a sample concentration of 1.0% by mass/% by volume, and an amount of sample injection of 100 μL.

In a case in which the lubricating oil composition of the disclosure includes such a viscosity index improver, the content of the viscosity index improver is preferably from 0.5% by mass to 20.0% by mass, more preferably from 1.0% by mass to 12.0% by mass with respect to the total mass of the oil composition.

(Ashless Dispersant)

The lubricating oil composition of the disclosure may contain an ashless dispersant. In a case in which the lubricating oil composition contains an ashless dispersant, friction characteristics of a wet clutch can be stabilized for a long period of time.

Examples of the ashless dispersant include a polyalkenyl group-containing succinimide and a boron derivative thereof.

Examples of the polyalkenyl group-containing succinimide preferably include a compound represented by the following formula (4).

Examples of the boron derivative of the polyalkenyl group-containing succinimide include a compound obtained by subjecting a compound represented by the following formula (4), to a treatment with an acid such as boric acid or a boric acid derivative.

(4)

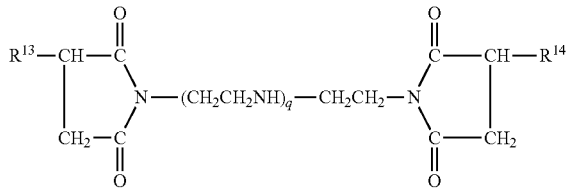

In the formula (4), each of $R^{13}$ and $R^{14}$ independently represents a polyalkenyl group, q denotes an integer of from 0 to 4, and q is preferably an integer of from 2 to 4, more preferably an integer of from 3 to 4.

The polyalkenyl group preferably has a number average molecular weight of from 800 to 2600, more preferably from 1200 to 2600, still more preferably from 1250 to 2600, particularly preferably from 1300 to 2600.

In a case in which the lubricating oil composition of the disclosure contains such a polyalkenyl group-containing succinimide, the content of the polyalkenyl group-containing succinimide is preferably from 0.001% by mass to 0.04% by mass, more preferably from 0.002% by mass to 0.02% by mass in terms of nitrogen concentration with respect to the total mass of the oil composition.

In a case in which the content of the polyalkenyl group-containing succinimide is in a range of from 0.001% by mass to 0.04% by mass, not only suppression of emulsion generation in incorporation of water is excellent, but also wear resistance can be exhibited.

(Other Additive)

The lubricating oil composition may contain, if necessary, any other known additive (hereinafter, also referred to as "such other additive".) than the zinc dialkyldithiophosphates X, such other zinc dialkyldithiophosphate, the metallic cleanser, the viscosity index improver, and the ashless dispersant.

Examples of such other additive include other additives such as a friction modifier, an oily agent, a wear prevention agent other than the zinc dialkyldithiophosphates X, an extreme pressure agent, a rust inhibitor, an antioxidant, a metal inactivator, a pour point depressant, a defoamer, a colorant, and a package additive for tractor hydraulic oil, and package additives for various lubricating oils, containing at least one selected from such other additive.

Examples of the friction modifier include an organomolybdenum compound, an ester compound of polyhydric alcohol and fatty acid, an amine compound, an amide compound, an ether compound, a sulfurized ester, a phosphoric acid ester, an acidic phosphoric acid ester and an amine salt thereof, and a diol.

Examples of the oily agent include oleic acid, stearic acid, a higher alcohol amine, amide, an ester, a sulfurized oil and a fat, an acidic phosphoric acid ester, and an acidic phosphorus acid ester.

Examples of the wear prevention agent include a sulfur compound, a phosphoric acid ester, a phosphorus acid ester, and an acidic phosphoric acid ester and an amine thereof.

Examples of the extreme pressure agent include a hydrocarbon sulfide, a sulfurized oil and a fat, a phosphoric acid ester, a phosphorus acid ester, a chlorinated paraffin, and a diphenyl chloride.

Examples of the rust inhibitor include carboxylic acid and an amine thereof, an ester compound, a sulfonic acid salt, and a boron compound.

Examples of the antioxidant include an amine-based antioxidant, a phenol-based antioxidant, and a sulfur-based antioxidant.

Examples of the metal inactivator include benzotriazole, thiadiazole, and an alkenyl succinic acid ester.

Examples of the pour point depressant include a polyalkyl methacrylate, a chlorinated paraffin-naphthalene condensate, and alkylated polystyrene.

Examples of the defoamer include a silicone compound such as dimethylpolysiloxane, a fluorosilicone compound, and an ester compound.

<Properties of Lubricating Oil Composition>

The lubricating oil composition of the disclosure preferably has a kinetic viscosity at 100° C. of from 6.0 $mm^2/s$ to 15.0 $mm^2/s$, more preferably from 7.0 $mm^2/s$ to 13.0 $mm^2/s$, still more preferably from 7.5 $mm^2/s$ to 11.0 $mm^2/s$.

The lubricating oil composition preferably has a viscosity index of 150 or more, more preferably 170 or more, still more preferably 190 or more.

In a case in which the kinetic viscosity at 100° C. and the viscosity index of the lubricating oil composition satisfy the above respective ranges, lubricity is retained and low-temperature startability is also more excellent.

The kinetic viscosity at 100° C. means a value obtained by measurement according to JIS K 2283 (2000) (ASTM D445). The viscosity index means a value obtained by calculation according to JIS K 2283 (2000).

<Method for Preparing Lubricating Oil Composition>

The method for preparing the lubricating oil composition may be any method including appropriately mixing not only the base oil and the zinc dialkyldithiophosphates X, and but also, if necessary, various additives.

The mixing order of the base oil, the zinc dialkyldithiophosphates X, and various additives is not particularly limited, and sequential mixing with the base oil may be made or various additives may be added to the base oil in advance.

<Application>

The lubricating oil composition of the disclosure encompasses a mode for use in an agricultural machine. Examples of such an agricultural machine include a tractor as a working machine for ground leveling, a rice transplanter as a working machine for growth management, and a binder and a combine as working machines for harvesting, which are agricultural machines. In particular, the lubricating oil composition can be suitably used in a tractor, and can be used as a common lubricating oil for a hydraulic pump unit, a transmission unit, a PTO clutch unit, a differential gear mechanism unit, a wet brake unit, and the like.

Examples

Next, the disclosure will be more specifically described with respect to Examples. The disclosure is not intended to be limited to such Examples at all.

In Examples and Comparative Examples, a base oil and an additive as each component were prepared in amounts compounded, as described in Table 1 or Table 2, thereby providing each lubricating oil composition.

Such each lubricating oil composition obtained was used to perform the following performance evaluations. The results are shown in Table 1 and Table 2.

In Table 2, "NA" represents no presence of any value. In Table 2, "-" represents "not measured".

<Base Oil>

Base Oil 1

The base oil A and the base oil B were mixed and prepared so that the amount of the base oil A was in a range of from 10% by volume to 20% by volume based on the total amount of the base oils.

Base oil A: Hydrorefined mineral oil (mineral oil-based lubricating oil) having a kinetic viscosity at 100° C. of 3.1 $mm^2/s$ and a viscosity index of 102

Base oil B: Hydrorefined mineral oil (mineral oil-based lubricating oil) having a kinetic viscosity at 100° C. of 5.8 $mm^2/s$ and a viscosity index of 109

Base Oil 2

Hydrorefined mineral oil (mineral oil-based lubricating oil) having a kinetic viscosity at 100° C. of 6.4 $mm^2/s$ and a viscosity index of 108

<Additives>

(1) Zinc Dialkyldithiophosphates

Compound $Z_1$; Zinc di-n-dodecanedithiophosphate (in the general formula (1), all the alkyl groups represented by each of $R^1$, $R^2$, $R^3$ and $R^4$ represented a primary alkyl group and the number of carbon atoms of the alkyl group was 12), phosphorus concentration; 6.1% by mass Compound $Z_2$; Zinc di-2-ethylhexyldithiophosphate (in the general formula (2), all the alkyl groups represented by each of $R^5$, $R^6$, $R^7$ and $R^8$ represented a primary alkyl group and the number of carbon atoms of the alkyl group was 8), phosphorus concentration; 7.4% by mass Compound $Z_3$; Zinc dialkyldithiophosphate (mixture in which the alkyl groups represented by each of $R^9$, $R^{10}$, $R^{11}$ and $R^{12}$ represented a primary alkyl group and the number of carbon atoms of the alkyl group was 4 or 5 in the general formula (3)), phosphorus concentration; 8.4% by mass (2) Commercially Available Hydraulic Oil Package Additive The package additive was a mixture of the following additives.

Metallic cleanser (calcium sulfonate overbased)

Friction modifier

Silicone-based defoamer

The amounts of main elements of the package additive were as follows.

Calcium: 7.3% by mass, sulfur: 1.4% by mass, nitrogen: 0.035% by mass, and silicone: 80 ppm by mass (3) Viscosity Index Improvers Viscosity index improver A; polyalkyl methacrylate (weight average molecular weight (Mw); 140000)

Viscosity index improver B; polyalkyl methacrylate (weight average molecular weight (Mw); 440000)

(4) Ashless Dispersant; Polybutenylbissuccinimide (Number Average Molecular Weight (Mn) of Polybutenyl Group: 1300, Nitrogen Content: 1.8% by Mass (5) Pour Point Depressant; Polyalkyl Methacrylate (Weight Average Molecular Weight (Mw); 60000)

The weight average molecular weight (Mw) and the number average molecular weight (Mn) are respective values obtained by measurement and calculation according to the above-mentioned methods.

[Performance Evaluation]

—Viscosity-Temperature Characteristics—

The kinetic viscosity at 100° C. was measured according to JIS K 2283(2000), and the viscosity index was calculated.

—Suppression Ability of Emulsion Generation—

A water mixing method shown as filterability evaluation described in SAE (SOCIETY of Automotive Engineers) Paper 972788 was performed. Specifically, the lubricating oil composition with which water was mixed was subjected to the following two tests, and suppression ability of emulsion generation and filtration performance of a filter were evaluated.

(Test A)

After 1 mL of water and 99 mL of the lubricating oil composition were added to a centrifuge tube, the resultant was stirred to thereby prepare a test oil, the test oil was left to still stand in a thermostat bath kept at 10° C., for one week, and the amount of an emulsion generated was measured. In a case in which the amount of the emulsion was 2.0 mL or less, it was determined that suppression of emulsion generation was excellent.

(Test B)

One mL of water and 99 mL of the lubricating oil composition were taken in a vial bottle with a lid, and stirred to thereby prepare a test oil. Next, the test oil was left to still stand in a thermostat bath kept at 60° C. After it was confirmed that the temperature of the test oil sufficiently reached 60° C., the vial bottle was taken out from the thermostat bath, and left at room temperature (for example, 25° C.) overnight (hereinafter, also referred to as "series of operations".). After the resultant was left overnight, the vial bottle was again placed in a thermostat bath kept at 60° C., the same series of operations as described above were performed and such operations were repeated three times in total.

Thereafter, the test oil was filtered by a filter, and the filtration time was measured. In a case in which the filtration time was 530 seconds or less, it was determined that filterability of the filter was excellent. The shorter the filtration time is, the more excellent the filterability of the filter is.

TABLE 1

| | Example 1 | Example 2 | Example 3 | Example 4 | Example 5 | Example 6 | Example 7 | Example 8 |
|---|---|---|---|---|---|---|---|---|
| Base oil 1 | Balance | Balance | Balance | Balance | Balance | Balance | Balance | — |
| Base oil 2 | — | — | — | — | — | — | — | Balance |
| Content ($P_1$) [% by mass] of compound $Z_1$ in terms of phosphorus concentration | 0.043 | 0.043 | 0.043 | 0.043 | 0.046 | 0.046 | 0.049 | 0.034 |

TABLE 1-continued

| | Example 1 | Example 2 | Example 3 | Example 4 | Example 5 | Example 6 | Example 7 | Example 8 |
|---|---|---|---|---|---|---|---|---|
| Content ($P_2$) [% by mass] of compound $Z_2$ in terms of phosphorus concentration | 0.026 | 0.030 | 0.037 | 0.037 | 0.043 | 0.044 | 0.048 | 0.030 |
| Content ($P_3$) [% by mass] of compound $Z_3$ in terms of phosphorus concentration | 0.025 | 0.021 | 0.012 | 0.008 | 0.010 | 0.008 | 0.008 | 0.008 |
| Total content (P) [% by mass] of zinc dialkyldithiophosphates X | 0.094 | 0.093 | 0.092 | 0.088 | 0.099 | 0.098 | 0.105 | 0.072 |
| $P_1$/P ratio | 0.46 | 0.46 | 0.46 | 0.49 | 0.46 | 0.46 | 0.46 | 0.47 |
| $P_1/P_2$ ratio | 1.65 | 1.44 | 1.15 | 1.15 | 1.07 | 1.03 | 1.01 | 1.13 |
| $P_3$/P ratio | 0.27 | 0.22 | 0.14 | 0.09 | 0.10 | 0.08 | 0.08 | 0.11 |
| Package additive (in terms of Ca) [% by mass] | 0.40 | 0.40 | 0.40 | 0.40 | 0.40 | 0.40 | 0.40 | 0.28 |
| Viscosity index improver A [% by mass] | 8.50 | 8.50 | 8.50 | 8.50 | 8.50 | 8.50 | 8.50 | 0.00 |
| Viscosity index improver B [% by mass] | 0.00 | 0.00 | 0.00 | 0.00 | 0.00 | 0.00 | 0.00 | 1.70 |
| Ashless dispersant (in terms of nitrogen) [% by mass] | 0.018 | 0.018 | 0.018 | 0.018 | 0.018 | 0.018 | 0.018 | 0.00 |
| Pour point depressant [% by mass] | 0.00 | 0.00 | 0.00 | 0.00 | 0.00 | 0.00 | 0.00 | 0.30 |
| [Properties] | | | | | | | | |
| Kinetic viscosity at 100° C. [$mm^2$/S] | 8.3 | 8.3 | 8.3 | 8.3 | 8.3 | 8.3 | 8.3 | 8.1 |
| Viscosity index | 215 | 215 | 215 | 215 | 215 | 215 | 215 | 135 |
| [Evaluation results] | | | | | | | | |
| Amount of emulsion [mL] | 1.9 | 1.5 | 1.6 | 1.9 | 1.7 | 1.9 | 2.0 | 1.7 |
| Filtration time [sec.] | 257 | 277 | 217 | 324 | 288 | 523 | 504 | 403 |

TABLE 2

| | Comparative Example 1 | Comparative Example 2 | Comparative Example 3 | Comparative Example 4 | Comparative Example 5 | Comparative Example 6 |
|---|---|---|---|---|---|---|
| Base oil 1 | Balance | Balance | Balance | Balance | Balance | Balance |
| Base oil 2 | — | — | — | — | — | — |
| Content ($P_1$) [% by mass] of compound $Z_1$ in terms of phosphorus concentration | 0.104 | 0.000 | 0.000 | 0.052 | 0.045 | 0.062 |
| Content ($P_2$) [% by mass] of compound $Z_2$ in terms of phosphorus concentration | 0.000 | 0.089 | 0.000 | 0.044 | 0.050 | 0.036 |
| Content ($P_3$) [% by mass] of compound $Z_3$ in terms of phosphorus concentration | 0.000 | 0.000 | 0.100 | 0.000 | 0.000 | 0.000 |
| Total content (P) [% by mass] of zinc dialkyldithiophosphates X | 0.104 | 0.089 | 0.100 | 0.096 | 0.095 | 0.098 |
| $P_1$/P ratio | 1.00 | NA | NA | 0.54 | 0.47 | 0.63 |
| $P_1/P_2$ ratio | NA | NA | NA | 1.17 | 0.90 | 1.72 |
| $P_3$/P ratio | 0.00 | 0.00 | 1.00 | 0.00 | 0.00 | 0.00 |
| Package additive (in terms of Ca) [% by mass] | 0.40 | 0.40 | 0.40 | 0.40 | 0.40 | 0.40 |
| Viscosity index improver A [% by mass] | 8.50 | 8.50 | 8.50 | 8.50 | 8.50 | 8.50 |
| Viscosity index improver B [% by mass] | 0.00 | 0.00 | 0.00 | 0.00 | 0.00 | 0.00 |
| Ashless dispersant (in terms of nitrogen) [% by mass] | 0.018 | 0.018 | 0.018 | 0.018 | 0.018 | 0.018 |
| Pour point depressant [% by mass] | 0.00 | 0.00 | 0.00 | 0.00 | 0.00 | 0.00 |
| [Properties] | | | | | | |
| Kinetic viscosity at 100° C. [$mm^2$/S] | 8.3 | 8.3 | 8.3 | 8.3 | 8.3 | 8.3 |
| Viscosity index | 215 | 215 | 215 | 215 | 215 | 215 |
| [Evaluation results] | | | | | | |
| Amount of emulsion [mL] | 3.9 | 0.5 | 6.1 | 2.2 | 2.1 | 3.3 |
| Filtration time [sec.] | 184 | Unfilterable | Unfilterable | 333 | 564 | 284 |

| | Comparative Example 7 | Comparative Example 8 | Comparative Example 9 | Comparative Example 10 | Comparative Example 11 |
|---|---|---|---|---|---|
| Base oil 1 | Balance | Balance | Balance | Balance | Balance |
| Base oil 2 | — | — | — | — | — |

TABLE 2-continued

| | | | | | |
|---|---|---|---|---|---|
| Content ($P_1$) [% by mass] of compound $Z_1$ in terms of phosphorus concentration | 0.043 | 0.052 | 0.046 | 0.046 | 0.049 |
| Content ($P_2$) [% by mass] of compound $Z_2$ in terms of phosphorus concentration | 0.041 | 0.022 | 0.048 | 0.047 | 0.048 |
| Content ($P_3$) [% by mass] of compound $Z_3$ in terms of phosphorus concentration | 0.000 | 0.025 | 0.008 | 0.008 | 0.004 |
| Total content (P) [% by mass] of zinc dialkyldithiophosphates X | 0.083 | 0.099 | 0.102 | 0.101 | 0.101 |
| $P_1$/P ratio | 0.51 | 0.52 | 0.45 | 0.46 | 0.48 |
| $P_1/P_2$ ratio | 1.05 | 2.34 | 0.95 | 0.98 | 1.01 |
| $P_3$/P ratio | 0.00 | 0.25 | 0.08 | 0.08 | 0.04 |
| Package additive (in terms of Ca) [% by mass] | 0.40 | 0.40 | 0.40 | 0.40 | 0.40 |
| Viscosity index improver A [% by mass] | 8.50 | 8.50 | 8.50 | 8.50 | 8.50 |
| Viscosity index improver B [% by mass] | 0.00 | 0.00 | 0.00 | 0.00 | 0.00 |
| Ashless dispersant (in terms of nitrogen) [% by mass] | 0.018 | 0.018 | 0.018 | 0.018 | 0.018 |
| Pour point depressant [% by mass] | 0.00 | 0.00 | 0.00 | 0.00 | 0.00 |
| [Properties] | | | | | |
| Kinetic viscosity at 100° C. [$mm^2$/S] | 8.3 | 8.3 | 8.3 | 8.3 | 8.3 |
| Viscosity index | 215 | 215 | 215 | 215 | 215 |
| [Evaluation results] | | | | | |
| Amount of emulsion [mL] | 2.3 | 2.5 | 1.9 | 1.9 | 2.3 |
| Filtration time [sec.] | 666 | 282 | 582 | 708 | — |

It was found that each of the lubricating oil compositions of Example 1 to Example 8, containing the zinc dialkyldithiophosphates X at a predetermined proportion in terms of phosphorus concentration, was not only small in the amount of an emulsion generated, but also short in the period taken for filtration by a filter, and thus was excellent in suppression of emulsion generation due to change in temperature after incorporation of water, as shown in Table 1.

In contrast, each of the lubricating oil compositions of Comparative Example 1 to Comparative Example 7, containing only any one of the compound $Z_1$ to the compound $Z_3$, was inferior in suppression of emulsion generation due to change in temperature after incorporation of water, or filterability of the filter, as compared with those of the Examples, as shown in Table 2.

In particular, Comparative Example 4 to Comparative Example 7 where no compound $Z_3$ was compounded each caused an emulsion to be generated in an amount of more than 2.0 mL, and were inferior in suppression of emulsion generation as compared with the Examples.

Each of the lubricating oil compositions of Comparative Example 8 to Comparative Example 11 in which relationships of formula (a) to formula (c) were not satisfied, even though all of the compound $Z_1$ to compound $Z_3$ were contained, was inferior in suppression of emulsion generation due to change in temperature after incorporation of water, or filterability of the filter, as compared with the Examples.

From the foregoing, the lubricating oil composition of the disclosure is excellent in suppression of emulsion generation due to change in temperature after incorporation of water and filterability of a filter, as shown in Example 1 to Example 8.

All documents, patent applications, and technical standards described herein are herein incorporated by reference, as if each individual document, patent application, and technical standard were specifically and individually indicated to be incorporated by reference.

The invention claimed is:

1. A lubricating oil composition comprising:

at least one base oil selected from a mineral oil-based lubricating oil, a synthetic oil-based lubricating oil, or a mixed oil thereof; and zinc dialkyldithiophosphates X consisting of a compound $Z_1$ represented by the following general formula (1), a compound $Z_2$ represented by the following general formula (2), and a compound $Z_3$ represented by the following general formula (3), wherein:

a total content of the zinc dialkyldithiophosphates X, in terms of phosphorus concentration, is 0.02% by mass or more with respect to a total mass of the oil composition, and the zinc dialkyldithiophosphates X satisfy the following formula (a), formula (b) and formula (c):

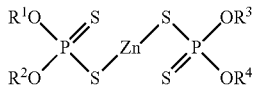

(1)

in the general formula (1), each of $R^1$, $R^2$, $R^3$ and $R^4$ independently represents a linear or branched primary alkyl group having from 10 to 20 carbon atoms;

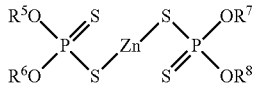

(2)

in the general formula (2), each of $R^5$, $R^6$, $R^7$ and $R^8$ independently represents a linear or branched primary alkyl group having from 7 to 9 carbon atoms;

(3)

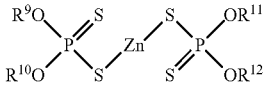

in the general formula (3), each of $R^9$, $R^{10}$, $R^{11}$ and $R^{12}$ independently represents a linear or branched primary or secondary alkyl group having from 3 to 6 carbon atoms; and $$0.30 \leq P_1/P \leq 0.50 \quad \text{formula (a)}$$

$$1.00 \leq P_1/P_2 \leq 2.00 \quad \text{formula (b)}$$

$$0.050 \leq P_3/P \leq 0.50 \quad \text{formula (c)}$$

P in the formula (a) and formula (c) represents the total content of the zinc dialkyldithiophosphates X in terms of phosphorus concentration with respect to the total mass of the oil composition, $P_1$ in the formula (a) and the formula (b) represents a content of the compound $Z_1$ in terms of phosphorus concentration with respect to the total mass of the oil composition, $P_2$ in the formula (b) represents a content of the compound $Z_2$ in terms of phosphorus concentration with respect to the total mass of the oil composition, and $P_3$ in the formula (c) represents a content of the compound $Z_3$ in terms of phosphorus concentration with respect to the total mass of the oil composition.

2. The lubricating oil composition according to claim 1, wherein each of $R^1$, $R^2$, $R^3$ and $R^4$ in the general formula (1) independently represents a linear primary alkyl group having from 10 to 12 carbon atoms.

3. The lubricating oil composition according to claim 1, wherein each of $R^9$, $R^{10}$, $R^{11}$ and $R^{12}$ in the general formula (3) independently represents a primary alkyl group having 4 or 5 carbon atoms.

4. The lubricating oil composition according to claim 1, wherein the lubricating oil composition is an agricultural machinery lubricating oil.

* * * * *